US007104227B2

(12) United States Patent
Roberts

(10) Patent No.: US 7,104,227 B2
(45) Date of Patent: Sep. 12, 2006

(54) INTERNAL COMBUSTION ENGINE MACHINE INCORPORATING SIGNIFICANT IMPROVEMENTS IN POWER, EFFICIENCY AND EMISSIONS CONTROL

(76) Inventor: Freddie Ray Roberts, c/o C. Madison Warren III, 201 Uffleman Dr., Suite C, Clarksville, TN (US) 37043

( * ) Notice: Subject to any disclaimer, the term of this patent is extended or adjusted under 35 U.S.C. 154(b) by 0 days.

(21) Appl. No.: 10/700,255

(22) Filed: Nov. 3, 2003

(65) Prior Publication Data

US 2004/0099228 A1 May 27, 2004

Related U.S. Application Data

(60) Provisional application No. 60/424,981, filed on Nov. 8, 2002.

(51) Int. Cl.
*F02B 75/22* (2006.01)

(52) U.S. Cl. ..... 123/55.7; 123/196 R; 123/41.33

(58) Field of Classification Search ..... 123/196 R, 123/196 AB, 74 R, 65, 65 VC, 55.6, 55.7, 123/41.33, 197.4

See application file for complete search history.

(56) References Cited

U.S. PATENT DOCUMENTS 2,825,319 A * 3/1958 Harrer ..... 123/46 A
6,209,495 B1 * 4/2001 Warren ..... 123/55.2

* cited by examiner

*Primary Examiner*—Tony M. Argenbright
*Assistant Examiner*—Katrina Harris

(57) ABSTRACT

A two stroke cycle internal combustion engine machine that does not require lubricating oil to be mixed with its fuel, producing greater efficiency, higher power to weight ratio, cooler operating temperatures, a wider speed range, greater simplicity, and lower toxic emissions, many of the improvements also transferable to four stroke engines.

30 Claims, 14 Drawing Sheets

INTERNAL COMBUSTION ENGINE MACHINE INCORPORATING SIGNIFICANT IMPROVEMENTS IN POWER, EFFICIENCY AND EMISSIONS CONTROL

CROSS REFERENCE TO RELATED APPLICATIONS

This application is based on provisional application Ser. No. 60/424,981, filed on Nov. 8, 2002.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of internal combustion engines and more specifically to an internal combustion engine machine incorporating significant improvements in power, efficiency and emissions control.

This invention was conceived in response to the need for greater simplicity, efficiency and power in internal combustion piston engine designs.

Although two-stroke cycle engine technology has many advantages, it has deficiencies have caused widespread legislative restriction on its use and, in the US, an outright EPA ban on it by the year 2006.

Additionally, in nations where sophistication of publicly available technology is low, the prevalent two-cycle technology is producing high levels of air pollution and creating excessive fuel and lubricating oil expense due to the fact that the lubricating oil is burned along with the fuel in inefficient combustion. However, it is the only technology that the users can afford to acquire and maintain. This invention was conceived to defeat these problems.

Prior internal combustion piston engine technology has been divided into two primary groups, two-stroke cycle engines and four-stroke cycle engines. Prior two-stroke cycle engine technology has a number of advantages over four-stroke cycle technology. These advantages are a higher power to weight ratio and greater design simplicity that results in low production and maintenance costs. Four-stroke technology, on the other hand retained advantages over two-stroke technology in efficiency, dependability, and clean operation. No prior technology produced the advantages of both types in one engine.

Two Stroke Engine Technology Prior Art in General

Prior two-stroke cycle engines suffer a number of deficiencies. They are inefficient, up to or beyond ten times less efficient than comparable four-stroke cycle engines. They also inconveniently require that oil be measured and mixed with their fuel. As a result, prior two-stroke cycle engines operate much less cleanly than comparable four-stroke cycle engines, produce several times the volume of toxic emissions over that of comparable four-stroke cycle engines, experience a high incidence of plug fouling, are notoriously undependable, and use excessive fuel and lubricant.

Previous attempts at improved two-stroke technology have included linier engine configurations with pistons in each piston pair located diametrically opposite one another, as does this invention. One such popular configuration is popularly known as the "Bourke" engine. However, such previous linier designs have had a comparably narrow range of RPM speeds within which they could perform. These speeds are unsatisfactory for many applications and also complicate engine performance and design parameters for the various internal components.

Prevalent conventional engine technology causes wear on the many moving machine parts, largely due to components of articulated motion. This wear is concentrated, in particular, on the pistons, piston rings, cylinders, wrist pins, connecting rod bearings; main bearings and other related principal parts.

In present conventional engine technology, high operating temperatures bring increased complexity and expense in engine design and choice of materials.

Present conventional technology is not adaptable to attain significant energy savings by being run on fewer than all cylinders, when full power is not required, letting the unused cylinders and pistons disconnect from the drive train and come to complete rest until again needed.

Cylinder Head Exhaust Valve Prior Art

A number of cam or hydraulically controlled cylinder head exhaust valves are taught in prior two-stroke technology, but none were found teaching cylinder head exhaust valves applied to spark ignited two-stroke technology. However, spark ignition is the more compatible, and therefore overwhelmingly more dominant, configuration for lightweight engines. Therefore, this new use of a cylinder head exhaust valve in application to spark ignited two-stroke technology with the resultant increase in efficiency and reduction in toxic emissions is a much-needed improvement.

U.S. Pat. No. 2,097,883 to Johansson teaches an exhaust valve for two-stroke cycle diesel engines (i.e., not spark ignited). The valve in that patent is specifically designed to control combustion chamber pressure in compression ignition engines.

Oil Hoarding Rings Prior Art

No use of rings on a piston for the purpose of sealing the lubricated space and retaining oil between them has been found in prior technology. In fact, U.S. Pat. No. 4,364,307 teaches against such usage, particularly noting that it would be inappropriate to place sealing rings both above and below a lubrication groove. That, however, is precisely one design characteristic of this invention. Dynamic Pressure Pump, Double-Acting Piston Rod and Multi-Function Pistons to Carry, Distribute, and Recover Lubrication Oil A number of patents teach the transport of lubrication oil via a piston rod and/or pistons adapted to distribute oil transported by such a rod. Some use dynamic energy to propel the oil. (The general principle of dynamic energy/pressure pumps is to apply dynamic energy to the medium, such as oil, by scooping it up and propelling it by rapid cyclical motion.) However, none of said patents provide for complete "round trip" oil circulation via this method. They transport oil only one-way. This necessarily limits utility of the oil in cooling the engine, for it must either be slowly metered out so as to prevent a significant amount of it burning with the normal engine combustion, or it must be restricted from the cylinder interior entirely.

Further, dynamical propulsion oil pumps and oil carrying piston rod systems consistently teach their use only in lubricating the piston wrist pins, or lubricating/cooling the bottoms of the pistons. None are designed, as this patent teaches, to provide the primary lubrication to cylinder walls plus a return route for the oil for complete circulation loops.

Examples include U.S. Pat. Nos. 2,569,103 and 2,645,213 (to Huber), U.S. Pat. Nos. 4,466,387, 4,502,421, and 4,515,110 (Perry), U.S. Pat. No. 2,865,349 (MacDonald), U.S. Pat. No. 3,633,468 (Burck), U.S. Pat. No. 3,992,980 (Ryan et al), and U.S. Pat. No. 3,930,472 (Athenstaedt), and U.S. Pat. No. 2,899,016 (Swayze).

Additional examples of systems incorporating piston rod oil transport also include pressure sealed walls at the base of their cylinders, as does this patent application. (These sealed walls are also known as "cross heads.") However, as in those described above, none provide for complete oil circulation cycles to include oil return from the engine cylinder to the sump. Examples of these include U.S. Pat. No. 1,268,056 (Ruether), U.S. Pat. No. 1,827,661 (Kowarick), U.S. Pat. No. 2,064,913 (Hedges), U.S. Pat. No. 2,244,706 (Irving) and U.S. Pat. No. 3,710,767 (Smith).

BRIEF SUMMARY OF THE INVENTION

An object of the invention is to provide an improved two-cycle reciprocating internal combustion engine that eliminates the previous disadvantages of two cycle technology as compared to four cycle technology, in that this engine produces higher efficiency, decreased toxic emissions, less fouling, and greater dependability while retaining the advantages of simplicity of production and of maintenance, and high power per unit weight.

Still yet another object of the invention is to provide an improved reciprocating internal combustion engine wherein, it is possible to increase the power or torque to weight ratio up to 100 percent or more over that of four-cycle technology without increasing the bore and stroke, compression ratio, or number of cylinders, while at the same time retaining a wide available range of RPMs, particularly including the most desirable or recommended operating engine speeds with special consideration given to friction heat and reciprocal motion, and thereby maintaining the most desirable aspiration conditions and reciprocating valve performance characteristics, resulting in a more efficient fuel consumption rate, over previous conventional or linier two-cycle engines.

Another object of the invention is to provide two-cycle engine that, unlike two cycle engines under previous technology, is not subject to the inconvenient necessity of mixing lubricating oil with the fuel in the same tank, nor in the combustion chamber.

A further object of the invention is to provide a two-stroke cycle internal combustion engine in which the lubricant circulates and is re-used independently from the fuel, thus using less lubricant.

Another object of the invention is to provide a two-cycle engine that, unlike two cycle engines under previous technology, is not subject to the extremely high pollutant emissions that result from the necessity of mixing lubricating oil with the fuel in the combustion chamber.

Still yet another object of the invention is to provide a two cycle engine that, unlike two cycle engines under previous technology, is not subject to the undependability and frequent spark plug fouling that results from the necessity of mixing lubricating oil with the fuel in the combustion chamber.

Another object of the invention is to provide a simple, compact engine structure that is, aside from the drive train, essentially symmetrical wherein oppositely disposed parts are substantially identical.

Yet another object of the invention is to provide an internal combustion engine that is simple and inexpensive to build and maintain.

Another object of the invention is to provide an improved reciprocating internal combustion engine wherein the wear caused by friction on piston, piston rings, cylinders, wrist pins, connecting rod bearings; main bearings another principal parts of the engine is significantly reduced below that of in conventional two-cycle or four-cycle engines having the same bore, stroke, compression ratio and number of cylinders through virtually eliminating piston side loads and the resultant piston and cylinder wear.

Yet another object of the invention is to produce an improved reciprocating internal combustion engine wherein each cylinder can produce one combustion stroke with each revolution of the crankshaft. This amounts to two power strokes for each piston pair for each shaft revolution and a power stroke for each movement of the piston rod.

Another object of the invention is to produce an improved reciprocating internal combustion engine wherein the piston rod travel between combustion strokes is 50 percent less than in present conventional two-cycle technology engines of the same bore and stroke, compression ratio, and number of cylinders, thus saving energy wasted in previous technology and saving commensurate fuel.

A further object of the invention is to provide an improved internal combustion reciprocating engine that runs significantly cooler than those of present technology, thus reducing corrosion and wear and making choice of applicable construction materials broader and less expensive. The improved cooling is derived from the increased lubricating/cooling oil flow provided and also from expansion cooling of the exhaust gases.

Another object of the invention is to provide an improved reciprocating internal combustion engine having increased life expectancy by reducing the need for the engine to labor excessively or to be operated in an R.P.M. speed range that is beyond the design capability originally intended or recommended in order to fulfill the requirements for torque and/or horsepower.

Another object of the invention is to provide a linear two-stroke cycle internal combustion engine that operates smoothly and efficiently over a wide range of rpm speeds.

Still yet another object of the invention is to provide an improved reciprocating internal combustion engine that is particularly adaptable to being run on fewer than all cylinders when full power is not required, letting unused banks of cylinders and pistons disconnect from the drive train and come to complete rest until again needed, thus saving energy and also ensuring that the load on each end of the piston rod remains substantially equal in that for any given fuel setting the force of the explosion is the same, that is, the unit force exerted upon the opposite ends of the piston rod by successive explosions is equal, even when a pair of pistons is put in "resting" mode.

A further object of the invention is to provide an internal combustion engine that can operate using a wide range of fuels to include alcohol, gasoline, diesel, and others.

Still yet another object of the invention is to provide an internal combustion engine that is easily adapted for glow plug, spark ignition or compression ignition.

Another object of the invention is to provide improved reciprocating internal combustion engine technology compatible to both two-cycle and four-cycle technology of increased simplicity over each or these present technologies.

Other objects and advantages of the present invention will become apparent from the following descriptions, taken in connection with the accompanying drawings, wherein, by way of illustration and example, three embodiments of the present invention are disclosed.

In accordance with preferred embodiments of the invention, there is disclosed a reciprocating internal combustion engine machine incorporating significant improvements in power, efficiency and emissions control, primarily by eliminating the mix lubricating oil with the engine fuel and segregating the lubricating oil and fuel at all times.

BRIEF DESCRIPTION OF THE DRAWINGS

The drawings constitute a part of this specification and include exemplary modes of the invention, which may be embodied in various forms. It is to be understood that in some instances various aspects of the invention may be shown exaggerated or enlarged to facilitate an understanding of the invention.

LISTS OF NUMBERED COMPONENTS FOR EACH FIGURE

FIG. 1

Figure 1:
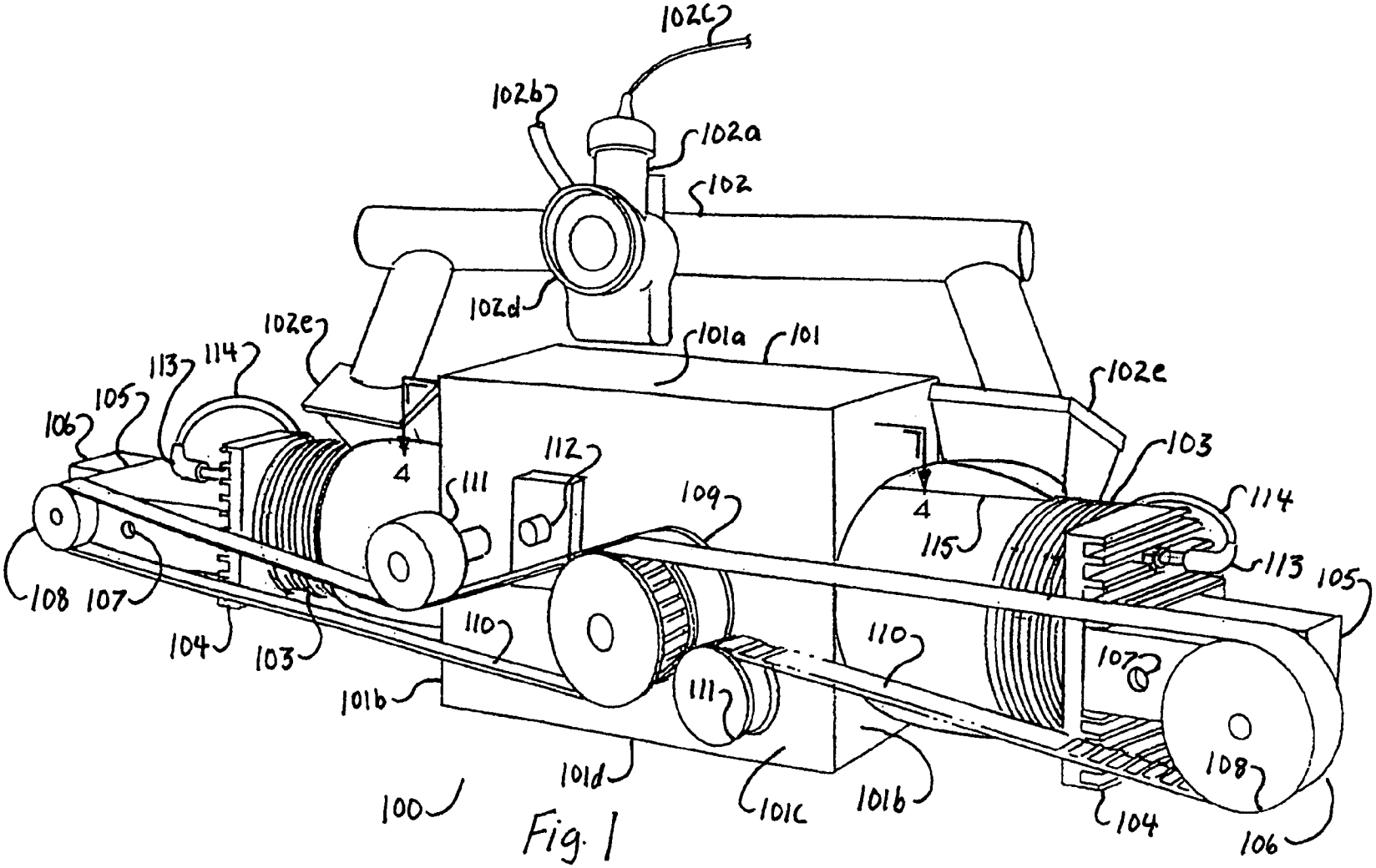
FIG. 1 is a perspective view of the engine in the first preferred mode from the back or "cam drive" side.

100 engine
101 oil sump/crank case
101*a* oil sump/crank case top and top plate
101*b* oil sump/crank case combination end walls/cylinder compression walls
101*c* oil sump/crank case side walls
101*d* oil sump/crank case bottom
102 air/fuel intake manifold
102*a* carburetor
102*b* fuel inlet
102*c* throttle cable
102*d* carburetor air intake
102*e* one-way air intake reed valve housing
103 cylinder
103*a* cylinder sidewall
104 cylinder head
105 exhaust assembly block
106 exhaust cam block
107 exhaust port to atmosphere
108 exhaust cam passive sprocket
109 exhaust cam power sprocket
110 exhaust cam drive belt
111 exhaust cam belt tension pulley
112 output drive shaft
113 spark-plug
114 spark-plug wires
115 air/fuel transfer passage cover

FIG. 2

105 exhaust assembly block
106 exhaust cam block
114 spark-plug wires
201 combination fly-wheel/starter cog
202 starter motor (engaged)
206 exhaust valve cam
207 magneto pick-ups

FIG. 3

101 oil sump/crank case
101*b* oil sump/crank case combination end walls/cylinder compression walls
103 piston cylinder
103*a* cylinder side wall
104 cylinder head
107 exhaust port to atmosphere
112 output drive shaft
113 spark-plugs
115 air/fuel transfer passage cover
301 oil
302 sump oil pick-up pipe
302*a* sump oil pick-up pipe nozzle
303 sump oil return outlet pipe
303*a* piston rod sump outlet port
304 piston rod
305 push rod
306 crank plate
306*a* cam drive shaft
307 output drive shaft cog
308 multi-function piston
308*a* piston oil inlet ports
308*b* piston oil outlet ports
308*c* oil hoarding rings
308*d* piston head
308*e* piston base
309 air/fuel transfer passage
311 exhaust valve
312 exhaust valve stem
313 exhaust valve stem ball
314 exhaust valve spring
315 exhaust valve cam
316 cylinder combustion chamber

Figure 3:
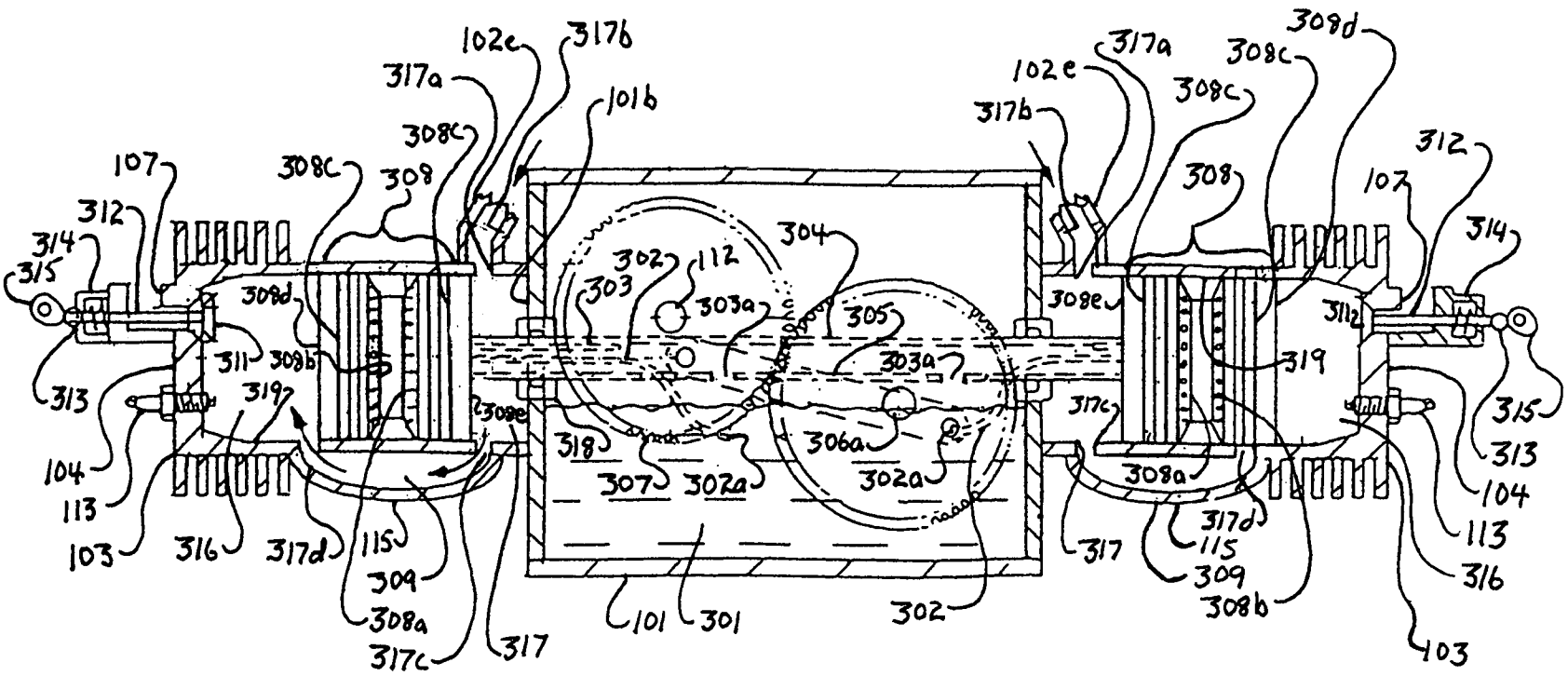
FIG. 3 is a cutaway view of the engine in the first preferred mode from the front or "output shaft" side.
Figure 3A:
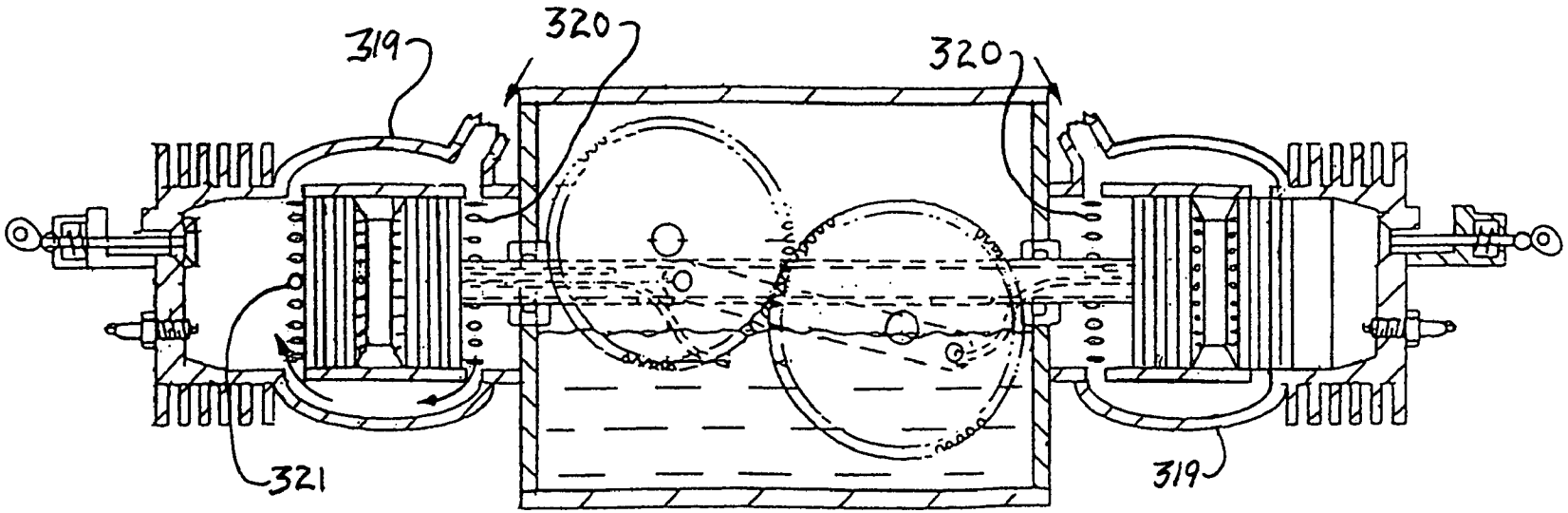
FIG. 3A is a cutaway view of the engine in the second preferred mode from the front or "output shaft" side.
Figure 3B:
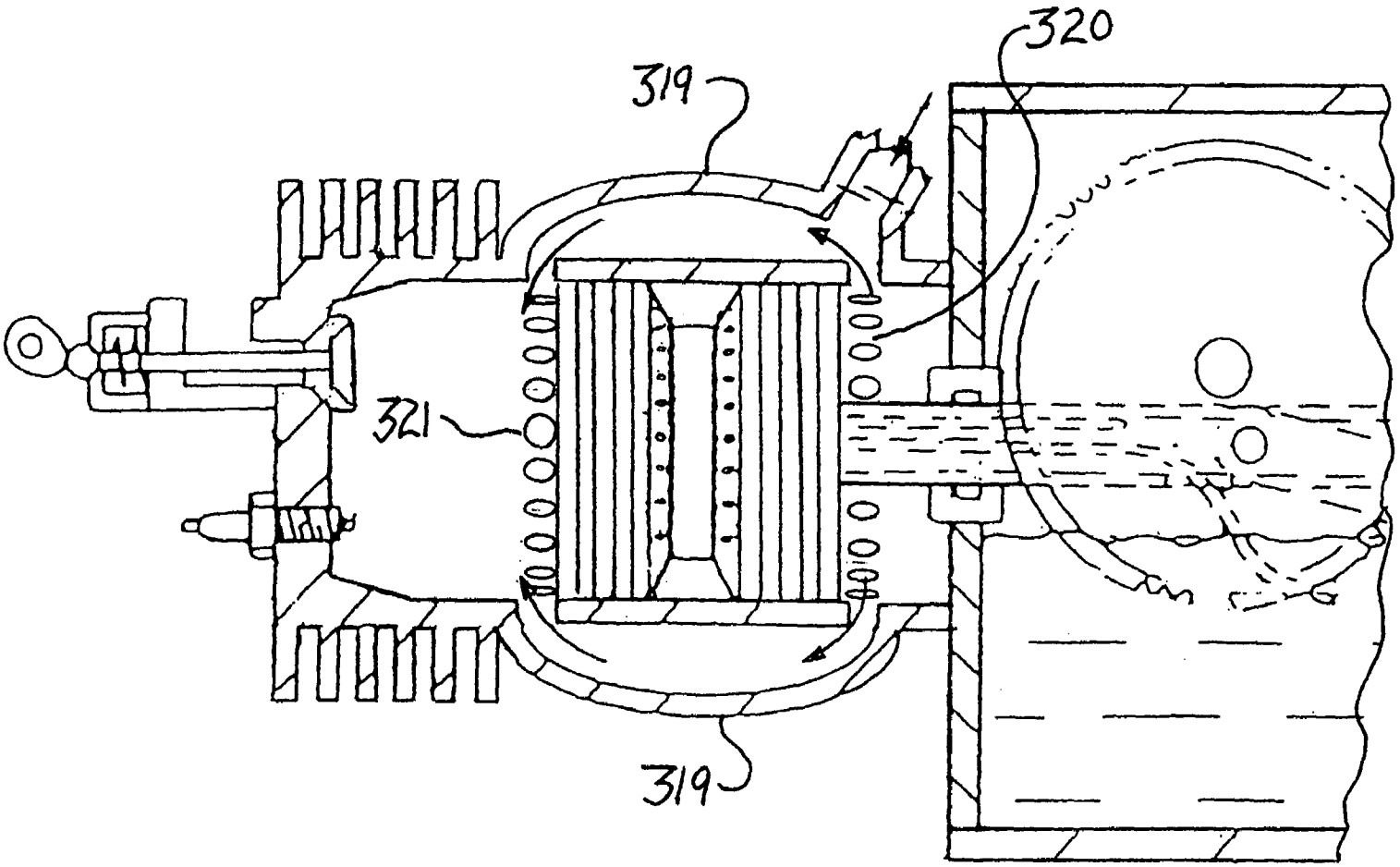
FIG. 3B is an expanded cutaway view of a section of the engine as illustrated in FIG. 3A.
Figure 3C:
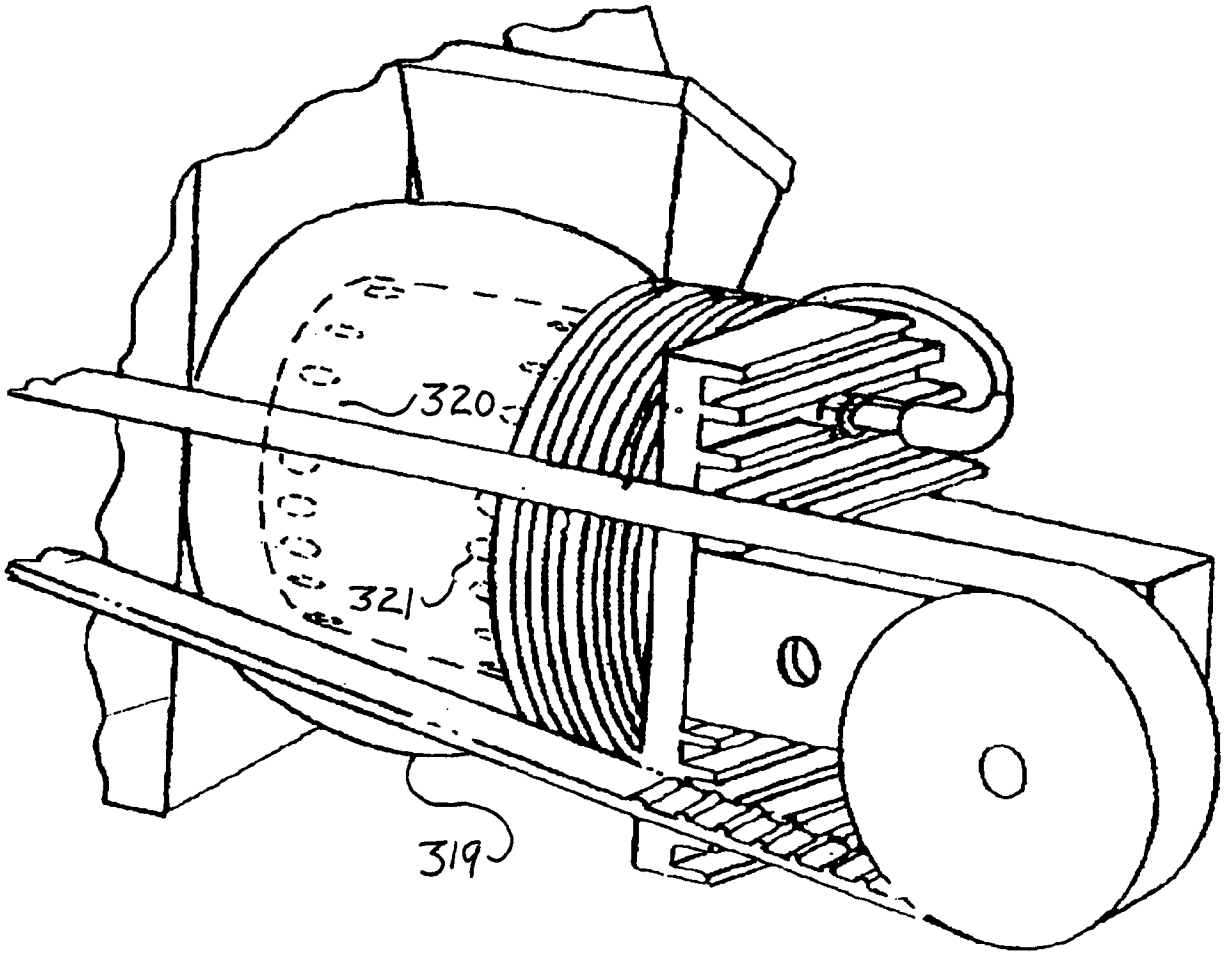
FIG. 3C is a perspective three quarter view with phantom images of the cylinder interior of the engine in the second preferred mode.
Figure 3D:
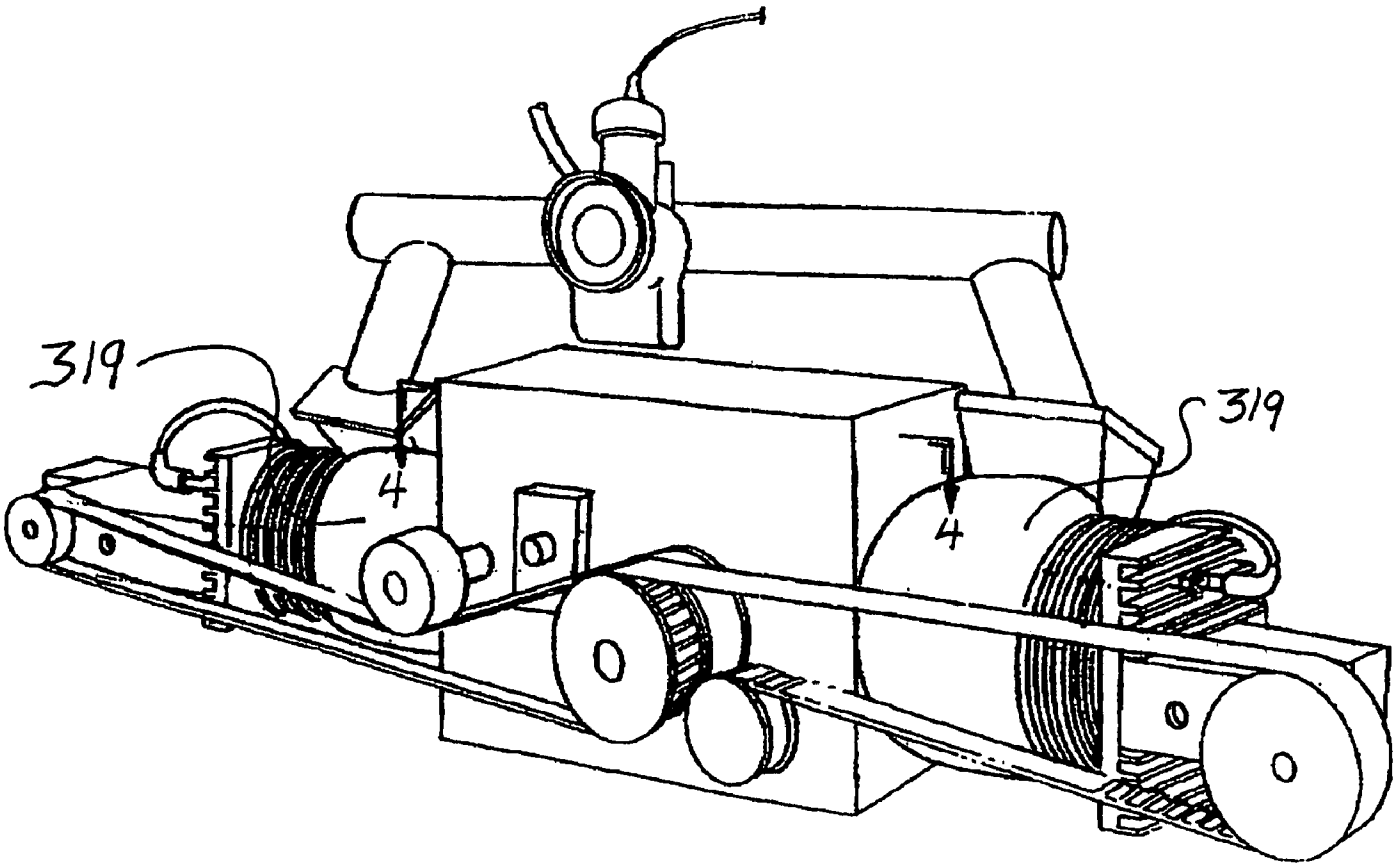
FIG. 3D is a perspective three quarter view of the engine in the second preferred mode.
Figure 4:
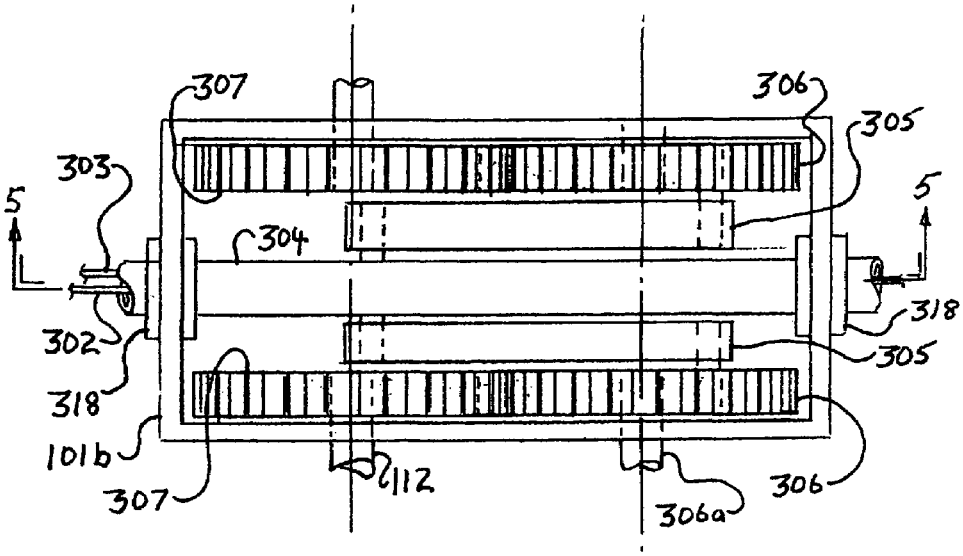
FIG. 4 is a view of the engine oil sump/crankcase, configured for the first or second preferred modes, from the top with the top-plate removed, providing a view of the gears.
Figure 5:
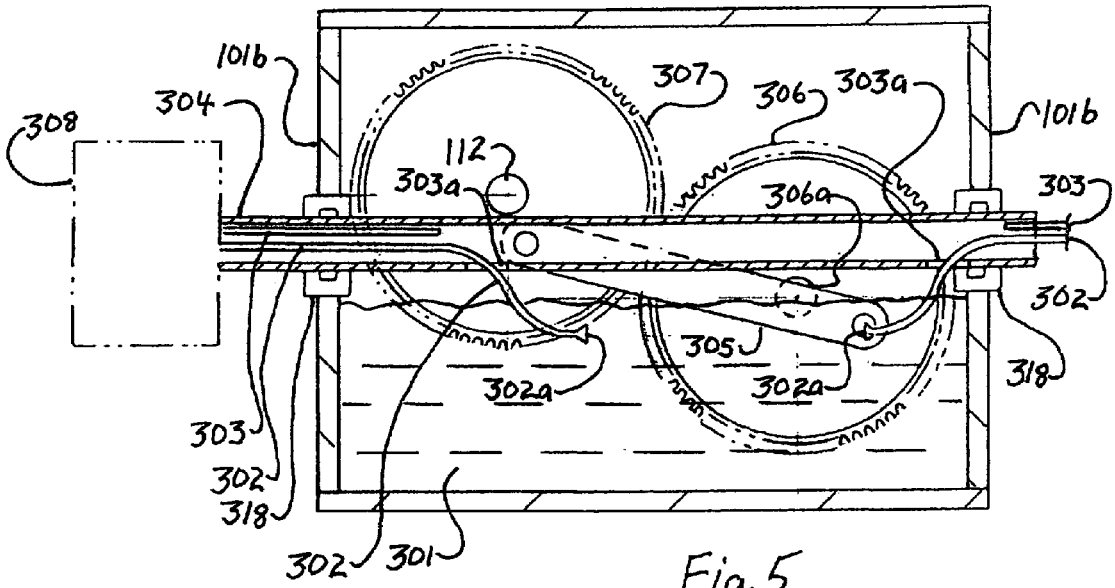
FIG. 5 is a cutaway view of the engine sump/crankcase, configured for the first or second preferred modes, from the back or "cam drive" side.
Figure 6:
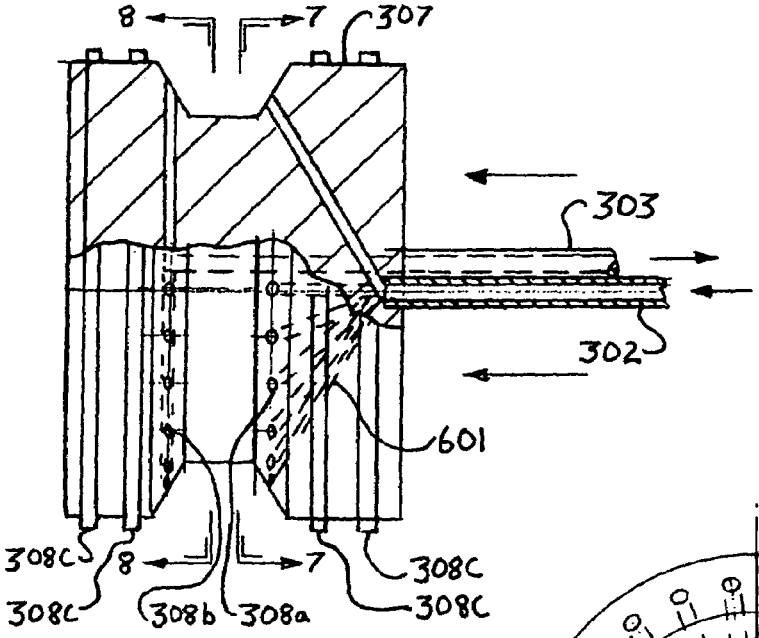
FIG. 6 is a partial cutaway side view of the multi-function piston configured for the first or second preferred modes.
Figure 7:
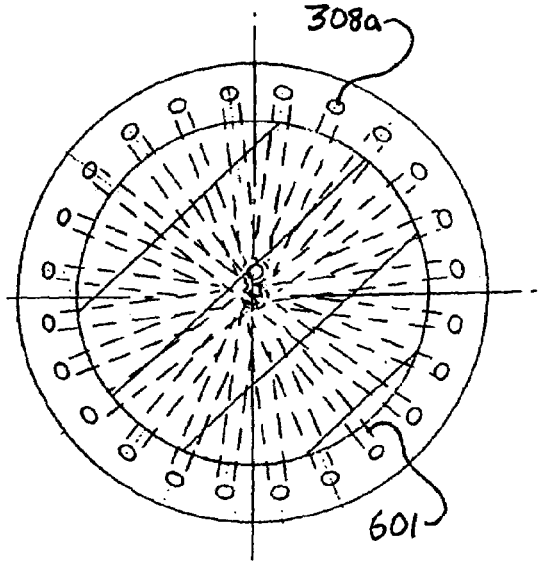
FIG. 7 is a top cutaway view of the multi-function piston configured for the first or second preferred modes.
Figure 8:
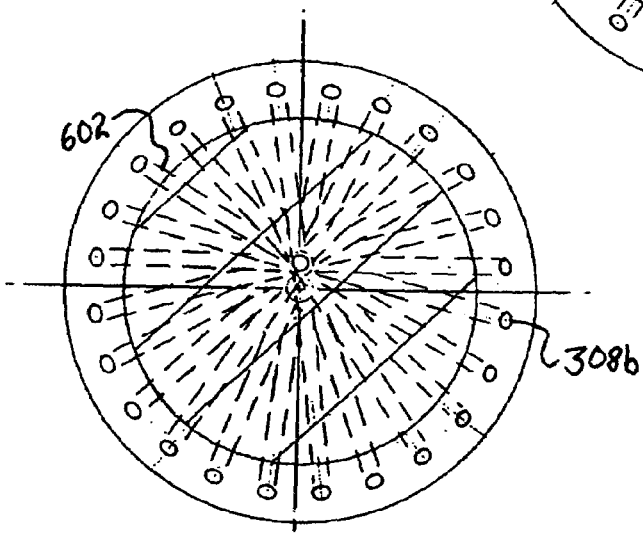
FIG. 8 is a bottom cutaway view of the multi-function piston configured for the first or second preferred modes.
Figure 9:
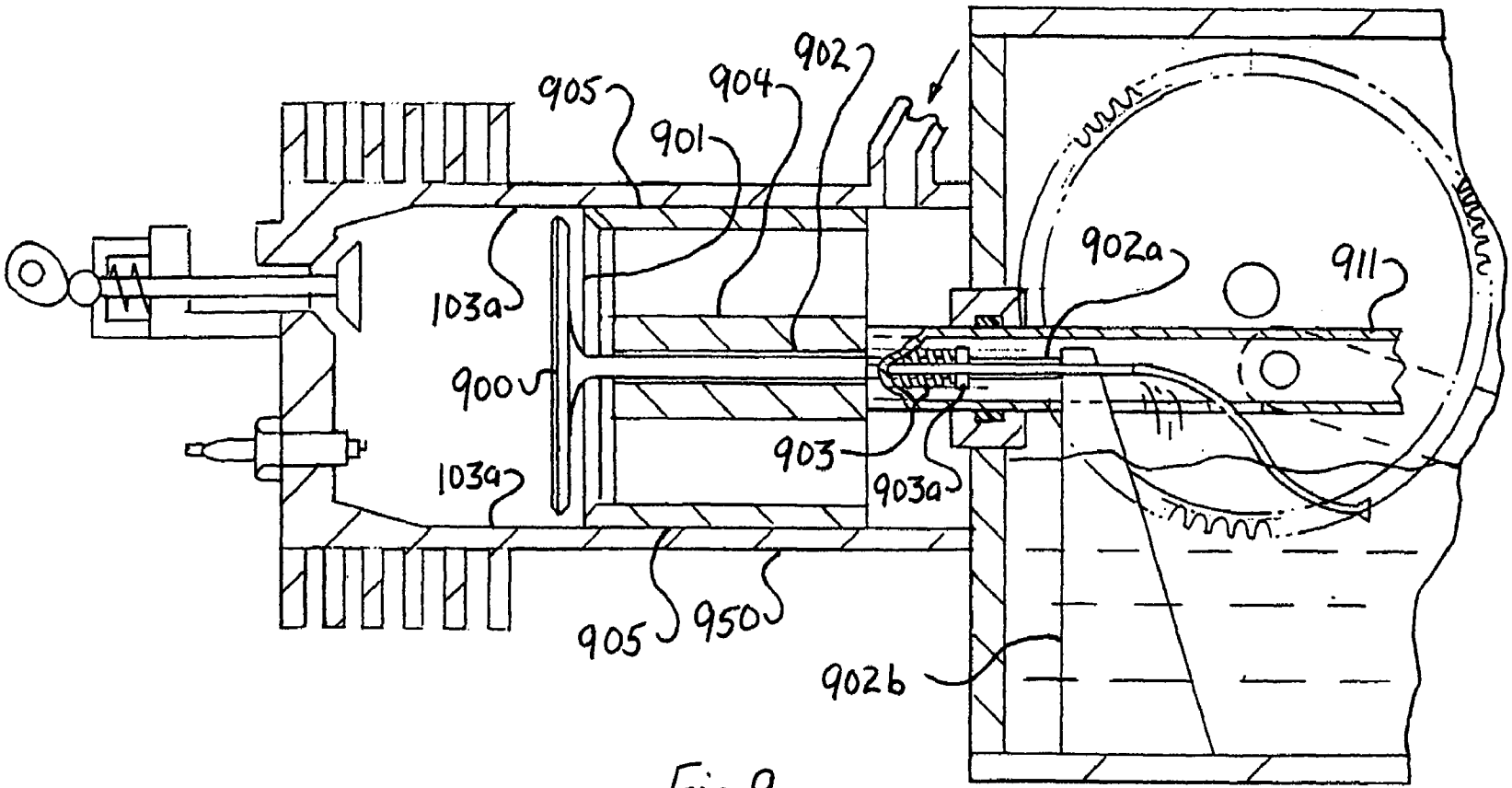
FIG. 9 is a cut-away view of a portion of the engine incorporating a "pop-top" multi-function piston as used in the third preferred mode.
Figure 10:
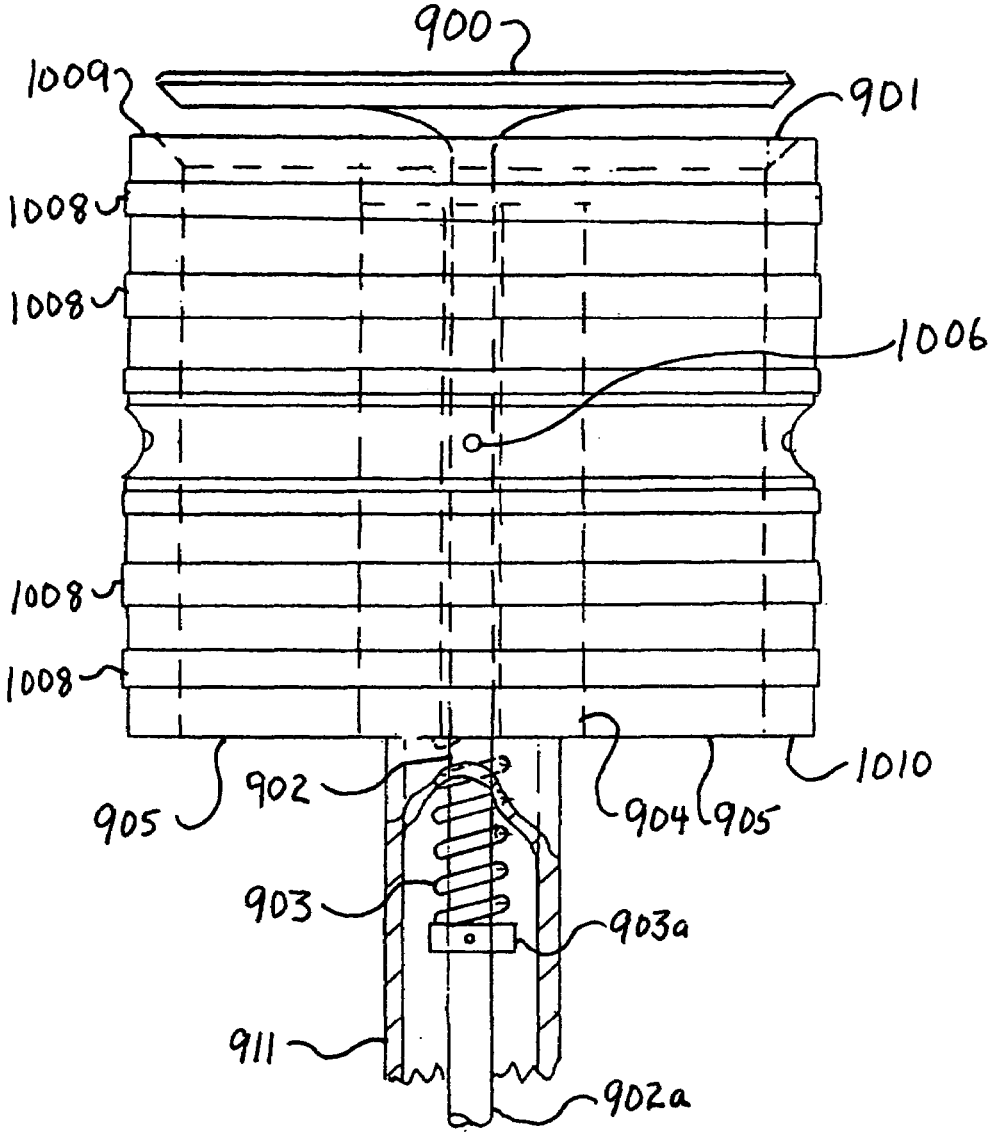
FIG. 10 is a side view of a "pop-top" multi-function piston having an air/fuel intake valve in its head, as used in the third preferred mode, with the valve in the open position.
Figure 11:
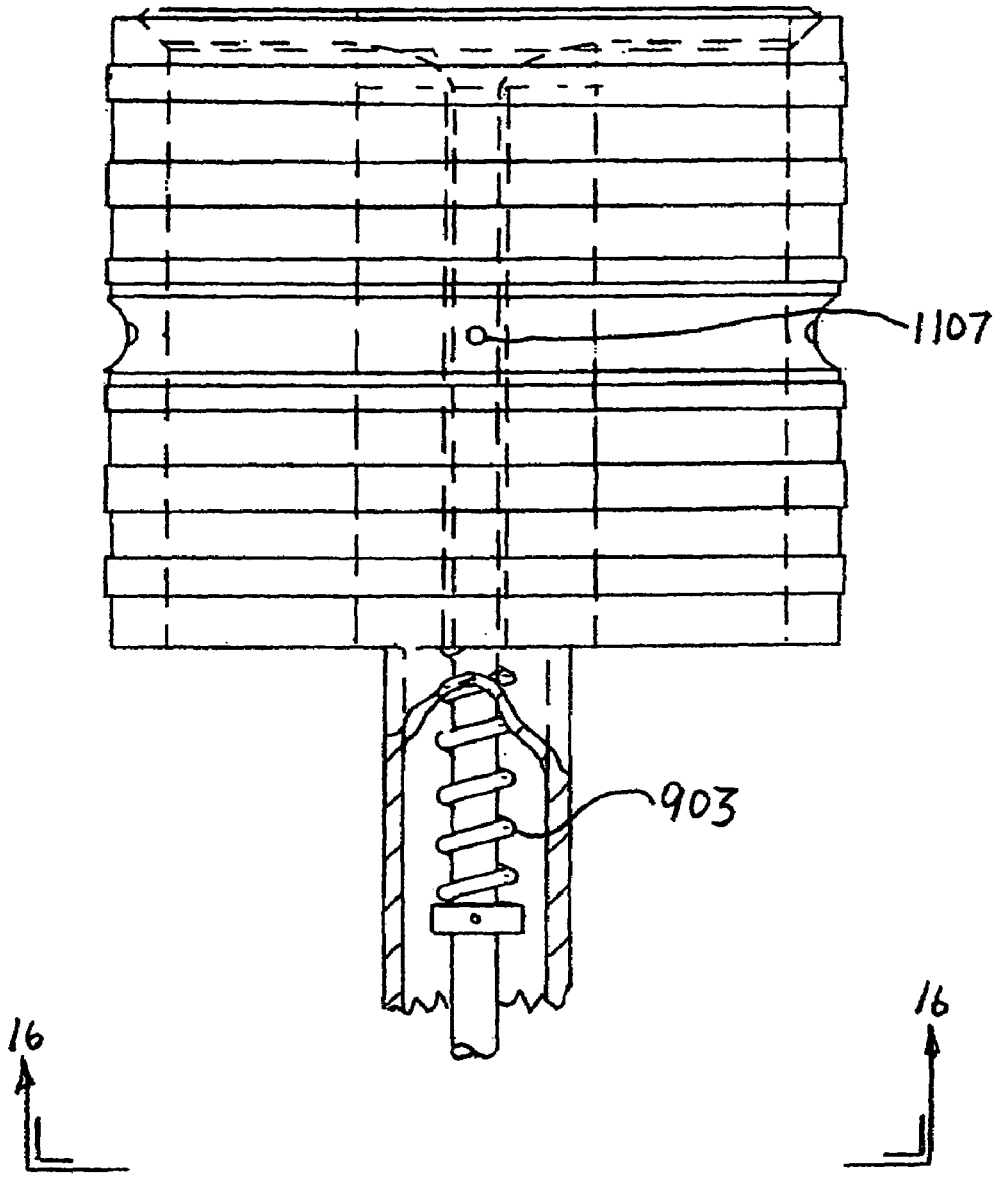
FIG. 11 is a side view of a "pop-top" multi-function piston of the third preferred mode as in FIG. 10, but with the air or air/fuel intake valve in the closed position.
Figure 12:
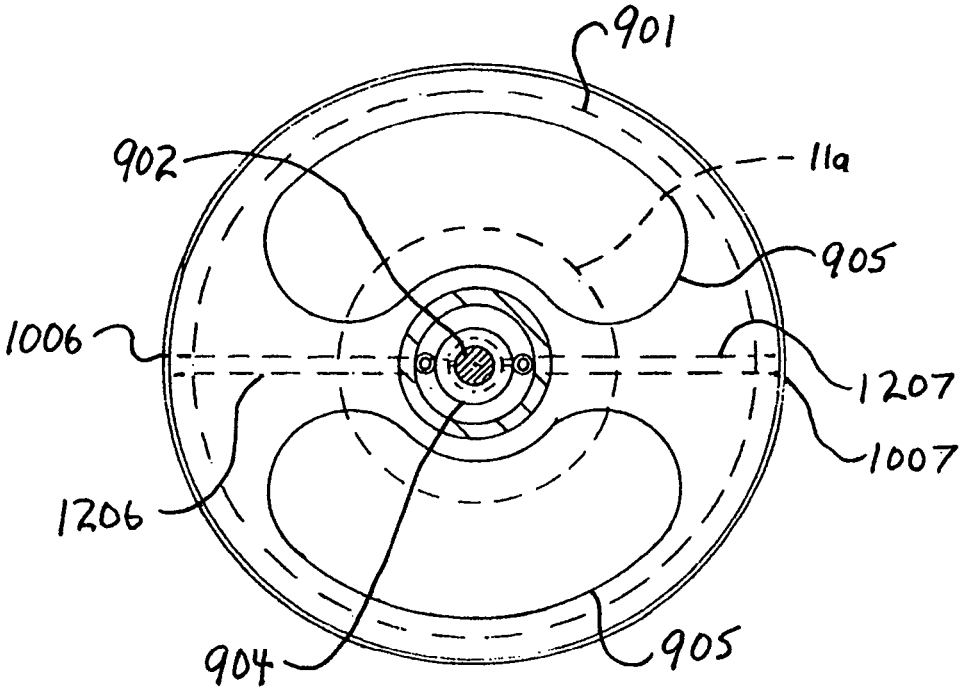
FIG. 12 is a top view of the "pop-top" multi-function piston used in the third preferred mode as represented in FIGS. 10 and 11.
Figure 12A:
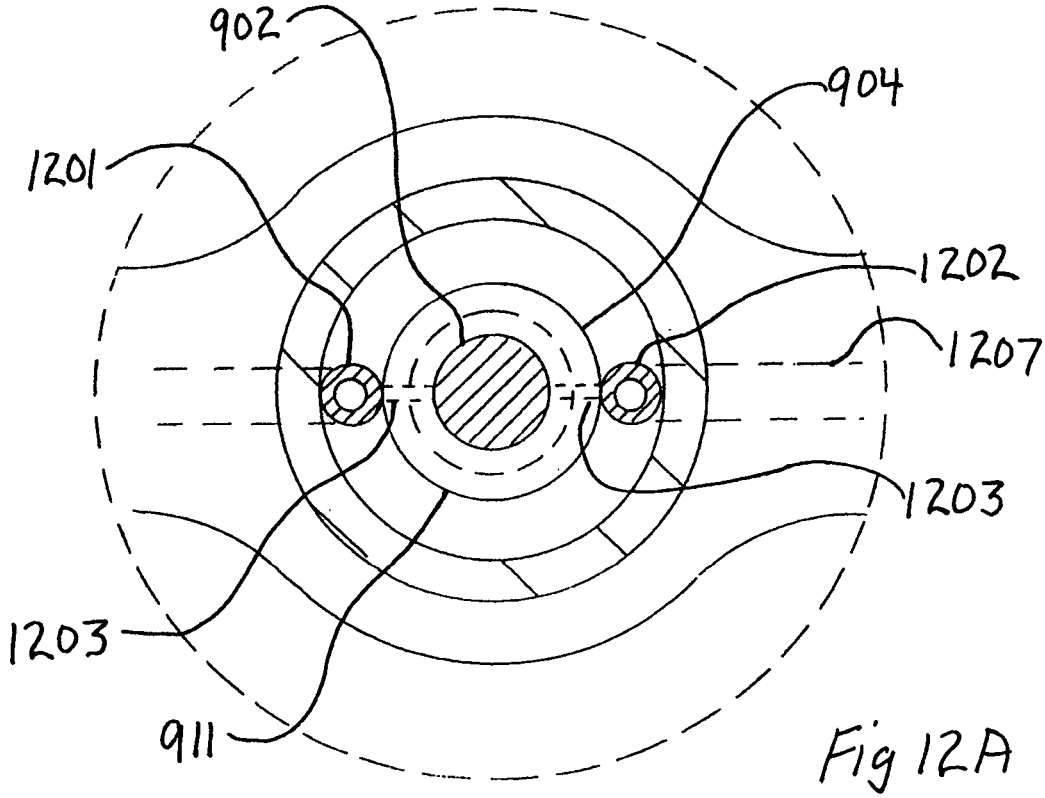
FIG. 12*a* is an expanded top view of the center section of the multi-function "pop-top" piston illustrated in FIG. 12.
Figure 13:
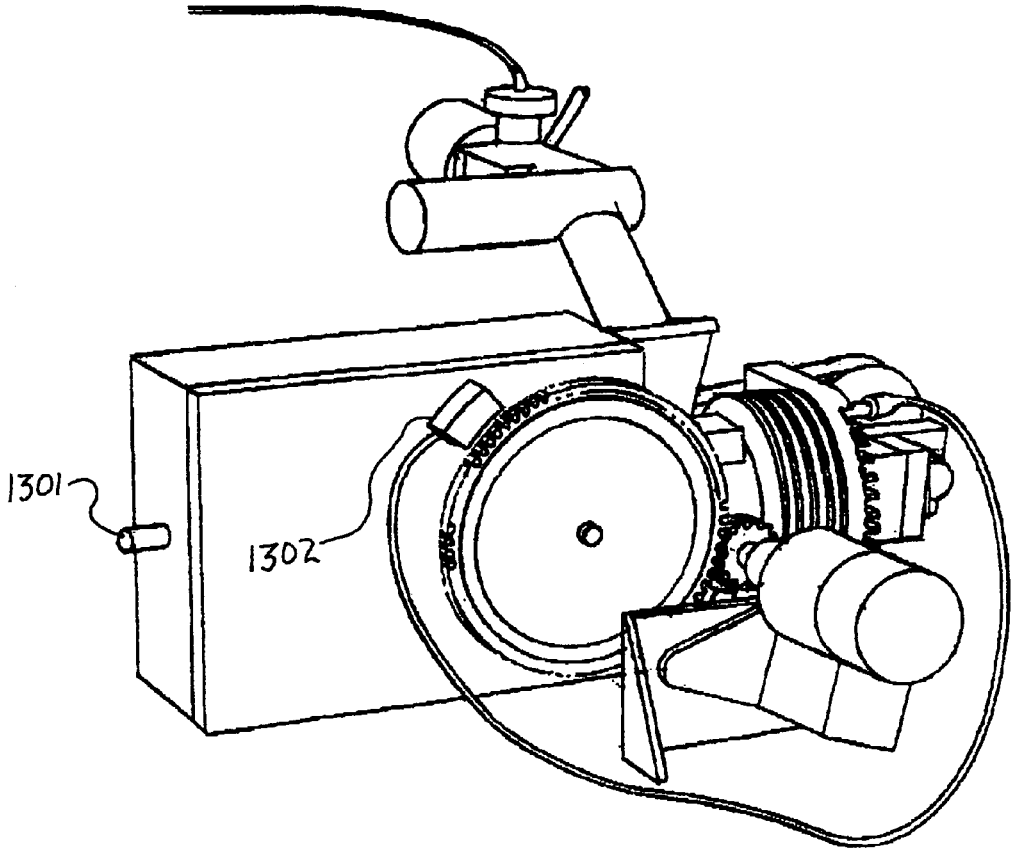
FIG. 13 is a perspective view of the engine in a single cylinder configuration, aspirated and lubricated after the manner of the first preferred mode.

317 cylinder compression chamber
317*a* cylinder compression chamber air or air/fuel inlet port
317*b* cylinder compression chamber air or air/fuel inlet port one-way reed valve
317*c* cylinder compression chamber air or air/fuel outlet port
317*d* cylinder combustion chamber air or air/fuel inlet port
318 pressure seal
FIG. 3A
319 air/fuel transfer passage circular cover
320 cylinder compression chamber air or air/fuel outlet circle of ports
321 cylinder combustion chamber air or air/fuel inlet circle of ports
FIG. 3B
319 air/fuel transfer passage circular cover
320 cylinder compression chamber air or air/fuel outlet circle of ports
321 cylinder combustion chamber air or air/fuel inlet circle of ports
FIG. 3C
319 air/fuel transfer passage circular cover
320 cylinder compression chamber air or air/fuel outlet circle of ports
321 cylinder combustion chamber air or air/fuel inlet circle of ports
FIG. 3D
319 air/fuel transfer passage circular cover
FIG. 4
101*b* oil sump/crank case combination end walls/cylinder compression walls
112 output drive shaft
302 sump oil pick-up pipe
302*a* output drive shaft
303 oil return outlet pipe
304 piston rod
305 push rod
306 crank plate
306*a* cam drive shaft
307 output drive shaft cog
318 pressure seal
FIG. 5
101*b* oil sump/crank case combination end walls/cylinder compression walls
112 output drive shaft
301 oil
302 sump oil pick-up pipe
302*a* sump oil pick-up nozzle
303 oil return outlet pipe
303*a* piston rod sump outlet port
304 piston rod
305 push rod
306 crank plate
306*a* cam drive shaft
307 output drive shaft cog
308 multi-function piston
318 pressure seal
FIG. 6
302 sump oil pick-up pipe
303 oil return outlet pipe
308*a* piston oil inlet ports
308*b* piston oil outlet ports
308*c* oil hoarding rings
601 piston oil inlet channels
602 piston oil outlet channels
FIG. 7
308*a* piston oil inlet ports
601 piston oil inlet port channels
FIG. 8
308*b* piston oil outlet ports
602 piston oil outlet port channels
FIG. 9
103*a* cylinder side wall
900 air or air/fuel intake valve head
901 valve seat
902 valve stem
902*a* valve rod
902*b* control peg
903 valve spring
903*a* valve spring collar
904 valve guide
905 air or air/fuel valve ports
907 piston oil supply port
908 piston oil return port
911 piston rod
950 multi-function piston
FIG. 10
900 valve head
901 valve seat
902 valve stem
902*a* valve rod
903 valve spring
903*a* valve spring collar
904 valve guide
905 air or air/fuel valve ports
911 piston rod
1006 piston oil supply port
1008 oil hoarding rings
1009 piston head
1010 piston base
FIG. 11
900 valve head
903 valve spring
1107 piston oil return port
FIG. 12
901 valve seat
902 valve stem
904 valve guide
905 air or air/fuel valve ports
1006 piston oil supply port
1007 piston oil return port
1206 piston oil supply channel
1207 piston oil return channel
FIG. 12*a*
902 valve stem
904 valve guide
911 piston rod
1201 sump oil pick-up pipe
1202 oil return outlet pipe
1203 valve stem oil pinhole
1206 piston oil supply channel
1207 piston oil return channel
FIG. 13
1301 reciprocating power shaft
1302 single, unpaired magneto pick-up

DETAILED DESCRIPTION OF THE PREFERRED EMBODIMENTS

The key novelties of this invention lie in its means of lubrication combined with its means of aspiration and exhaust. A number of alternative modes are offered and they can be "mixed and matched" as needs dictate. Note that in every mode described, fuel injection may be substituted for carburetion, providing increased performance, but at the expense of increased system complexity and monetary cost.

Referring to FIG. 1, the engine in the first preferred mode, a two-stroke cycle dynamic pressure powered lubrication configuration (100), has a combination oil sump/crankcase (101) with a top and top plate (101*a*) and combination end walls/cylinder compression walls (101*b*), side-walls (101*c*) and a bottom (101*d*). It includes an air/fuel intake manifold (102), a carburetor (102*a*), a fuel inlet (102*b*), a throttle cable (102*c*), a carburetor air intake (102*d*) and a one-way air intake reed valve (102*e*).

On either end of the combination oil sump/crankcase is a cylinder (103) with a sidewall (103*a*), cylinder head (104), exhaust assembly block (105) exhaust cam block (106) having an exhaust port to atmosphere (107), an air or air/fuel transfer cover (115) and an exhaust cam passive sprocket (108). On each cylinder head is also mounted an air/fuel transfer passage cover and a spark plug (113) with spark plug wire (114) attached.

Extending from the facing side wall of the oil sump/crankcase is an output drive shaft (112), a shaft with exhaust cam power sprockets (109) linked to exhaust cam passive sprockets (108) by two exhaust cam drive belts (110), tensioned by an exhaust cam drive belt tensioning pulley (111).

Figure 2:
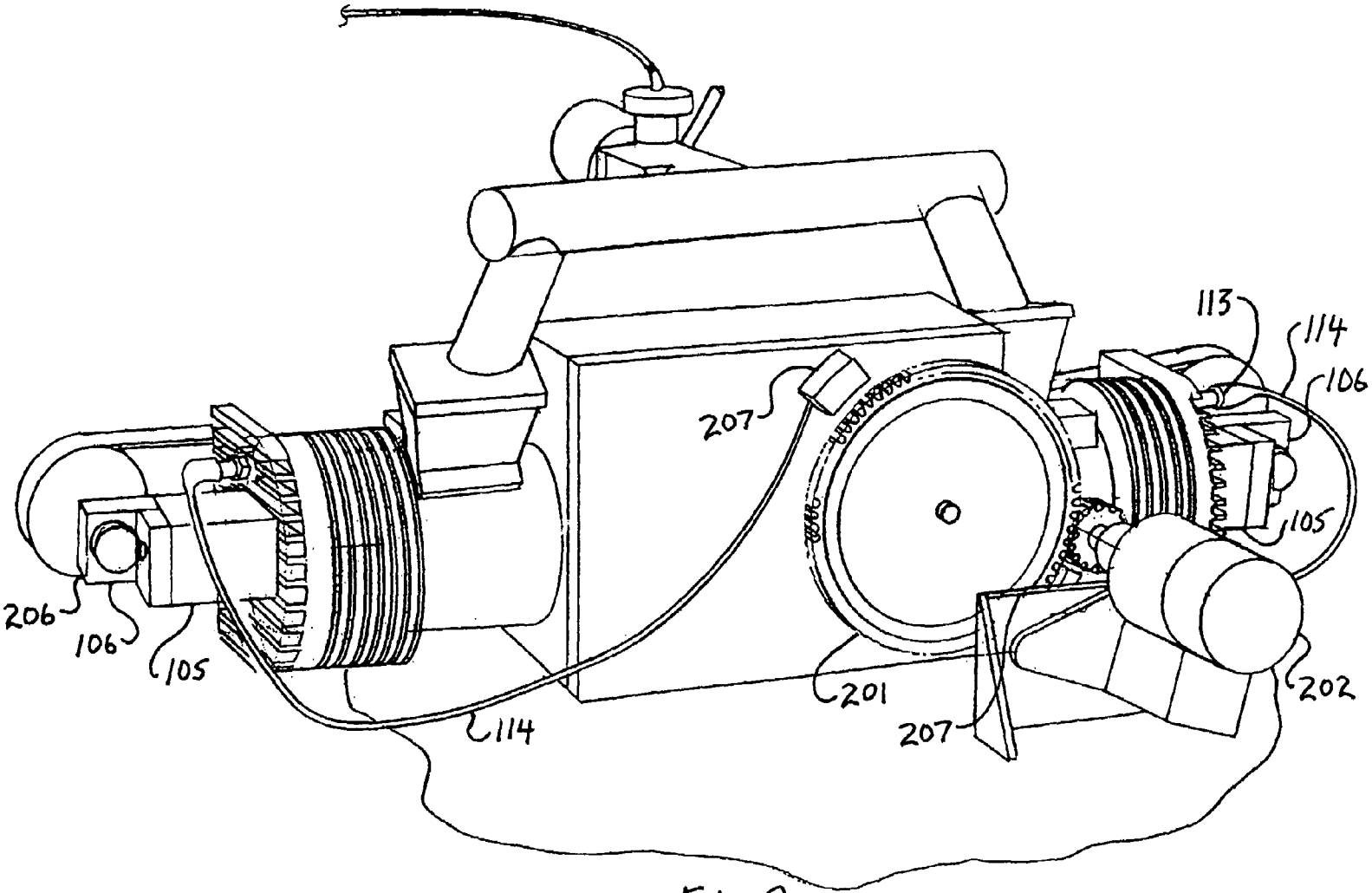
FIG. 2 is a perspective view of the engine in the first preferred mode from the front or "output shaft" side.

Referring to FIG. 2, viewing the engine of FIG. 1 from the opposite side, now additionally detailed are the exhaust assembly block (105), the exhaust cam block (106), the combination flywheel/starter cog (201), the starter motor, shown engaged for starting (202), the exhaust valve cam (206) and the magneto pick-ups (207) connected to the spark plug wires (114).

Referring to FIG. 3, which is a partial cut-away view with multi-function pistons intact, one may observe a number of the features that provide a cleaner, more efficient, more dependable, more powerful and more conveniently operated system than extant in prior technology.

Keys to this invention are the features that allow engine oil and fuel to remain separate throughout the combustion process. Prior conventional two-cycle engine designs required lubricating oil to be measured and mixed with their fuel. This caused the engines to "burn dirty," producing prodigious levels of toxic emissions, low efficiency, and poor dependability due to constant plug and system fouling. This invention overcomes such problems by incorporating improved aspiration systems and oil circulation systems that allow lubrication while segregating the lubricant from fuel and combustion.

One preferred mode, employing (as all preferred modes do) a dynamic pressure lubrication pump system, is illustrated in FIG. 3. Each cylinder (103) has a side-wall (103*a*), oil sump/crank case combination end walls/cylinder compression wall (101*b*) that segregates compression chamber (317) fuel and/or air from oil (301) in the crank case/sump (101). This wall is an important key to keeping oil out of the combustion chamber (316). In conventional technology, this wall is absent, leaving the cylinder open to the crankcase. This wall (101*b*) and its pressure seal (318) also serve as a guide to the piston rod (304) that keeps the rod traveling in strictly linier motion, reducing cylinder wear.

In this configuration, oil (301) is picked up by nozzles (302*a*) of pick-up pipes (302) extending from the piston rod (304) into the crank case/sump (101). These nozzles are thrust to and fro in a reciprocating manner through the sump oil (301) due to the motion of the piston rod (304) to which they are attached. On each thrust, oil is forced into one or the other nozzle by dynamic pressure. The nozzles may be flared in order to increase the dynamic pressure applied. Oil passes through the nozzle, enters the sump oil pick-up pipe (302), via which it then travels to the multi-function piston (308) where it exits via the piston oil inlet ports (308*a*) and circulates about the multi-function piston (308) between the oil hoarding rings (308*c*) that prevent the oil (301) from coming in contact with combustion fuel and air or combustion products above or below the multi-function piston (308). As it circulates, continued static pressure from additional oil feed, plus dynamic pressure caused by reciprocating piston rod motion causes the oil to re-enter the multi-function piston (308) through the piston outlet ports (308*b*) from whence it travels back down the piston rod (304) via an oil return outlet pipe (303) to drip through the piston rod sump outlet (303*a*) back into the crank case/sump (101) where it cools. Thus, lubricating oil circulation is completed without the oil ever coming into contact with combustion fuel or air.

The oil (301) rests in the sump (101) where its cooling is promoted through stirring by motion of the sump oil pick-up pipe (302) until it again enters the circulation system.

This diagram illustrates means by which engine performance is further enhanced through the addition of an exhaust valve (311) in each cylinder head (104). Note that each cylinder (103) has an intake port (317*d*) that resembles and functions in much the same manner those in present popular two-cycle engines. However, the exhaust valve (311) in the cylinder head (104) replaces the standard prior technology exhaust port on the cylinder side-wall. Action of this valve may be independently adjusted in such a way as to obtain maximum scavenging effect, best combustion and best compression time and pressure, allowing the engine to burn more cleanly and making the engine more readily compatible with a wider range of fuels than in previous conventional technology.

Further detailed in FIG. 3, are the oil sump/crank case (101), oil in the sump (301), sump oil pick-up pipes (302), sump oil pick-up nozzles (302*a*), oil return outlet pipes (303) and piston rod oil return outlet ports (303*a*).

A piston rod (304) is linked by a push rod (305) to a crank plate (306) that turns a cam drive shaft (306*a*) and meshes with an output shaft cog (307) driving an output drive shaft (112). Oil (301) contained in the oil sump/crank case splashes as the various contained components move, thus ensuring complete lubrication of all parts encased therein.

Connected to each end of the piston rod is a multi-function piston (308) having piston oil inlet ports (308*a*), piston oil outlet ports (308*b*), oil hoarding rings (308*c*), a piston head (308*d*), and a piston base (308*e*).

Each cylinder (103) has a head (104) with an exhaust valve (311), exhaust valve stem (312), exhaust valve stem ball (313), exhaust valve spring (314), and exhaust valve cam (315), exhaust ports to atmosphere (107), and spark plugs (113).

Each cylinder has a combustion chamber (316), a compression chamber (317), compression chamber air or air/fuel inlet port (317*a*), compression chamber air or air/fuel inlet port one way reed valve (317*b*), compression chamber air or air/fuel outlet port (317*c*), combustion chamber air or air/fuel inlet port (317*d*), an air or air/fuel transfer passage (309) leading from the compression chamber to the combustion chamber including an air/fuel transfer passage cover (115). At the base of each cylinder is a pressure seal (318) in the oil sump/crankcase combination end walls and cylinder compression walls (101*b*), through which the piston rod (304) passes.

FIG. 3A illustrates an alternative preferred mode with respect to the air or air/fuel transfer passage ports. Instead of equipping each cylinder with a small, elongated air or air/fuel transfer passage and cover with ports into the cylinder at either end (as described in the previously presented mode) this mode substitutes a donut shaped, circular cover (319) that surrounds the cylinder. Under this cover, the cylinder is circled at either end by a ring of outlet ports (320), and inlet ports (321) to facilitate high volume, evenly distributed air flow.

FIG. 3B is an enlarged image of a portion of FIG. 3A showing the donut shaped, circular cover (319) that surrounds the cylinder, and the cylinder circled at either end by a ring of outlet ports (320) and inlet ports (321).

FIG. 3C further illustrates the features exhibited in FIG. 3B, pointing out the donut shaped, circular cover (319) that surrounds the cylinder and the cylinder circled at either end by a ring of outlet ports (320), and inlet ports (321).

FIG. 3D shows the entire exterior arrangement of the engine employing the donut shaped, circular cover (319) that surrounds the cylinder.

Now referring to FIG. 4, further detailed for an engine configured in the first or second preferred modes are the combination end walls/cylinder compression walls (101*b*), the sump oil pick up pipe (302), the sump oil pick-up pipe nozzle (302*a*), oil return pipe (303), piston rod (304), push rod (305), crank plate (306), cam drive shaft (306*a*), output drive shaft cog (307), output drive shaft (112) and pressure seal (318).

Turning to FIG. 5, expanding on the view in FIG. 4, we can see the combination end walls/cylinder compression walls (101*b*), the oil (301), the sump oil pick up pipe (302), the sump oil pick-up pipe nozzle (302*a*), oil return pipe (303), piston rod sump oil outlet port (303*a*), piston rod (304), push rod (305), crank plate (306), cam drive shaft (306*a*), output shaft cog (307), output drive shaft (112), the multi-function piston (308) and pressure seals (318).

FIG. 6 presents closer detail of the multi-function piston as configured for the first preferred lubrication mode, showing the sump oil pick-up pipe (302), the oil return outlet pipe (303), the piston oil inlet ports (308*a*), the piston oil outlet ports (308*b*), the oil hoarding rings (308*c*), the piston oil inlet channels (601), and the piston oil outlet channels (602).

FIG. 7, a cut-away view, further details the multi-function piston shown in FIG. 6 showing the piston oil inlet ports (308*a*) and the piston oil inlet channels (601).

FIG. 8, a cut-away view, further details the multi-function piston of FIG. 6, showing piston oil outlet ports (308*b*) and the piston oil outlet channels (602).

Referring to FIG. 9, the key part to the third preferred mode is displayed. This is the "pop top piston" system and this mode provides the most effective means of keeping fuel and lubricant separated in that is allows no overlap whatsoever in the lubrication and aspiration systems. FIG. 9 illustrates the entire system for one cylinder, clearly showing the relationships of the "pop-top" piston system components, to include the control peg (902*b*).

This system includes a piston (950), air or air/fuel ports (906), a piston rod (911), piston oil supply port (907), piston oil return port (908), air or air fuel intake valve head (900), valve seat (901), valve stem (902), valve spring (903), valve spring collar (903*a*), valve guide (904). The system also includes a valve rod (902*a*) and a control peg (902*b*).

Detailed is a multi-function piston configured for the third preferred mode. In this mode, an air or air/fuel mixture intake valve head (900) and intake ports (905) are actually located each the piston head. By substituting these valves and ports fixed intake ports in the cylinder side-wall (103*a*), increased control over air/fuel aspiration becomes possible. In this figure, the piston intake valve head (900) is open. Note that the valve stem (902) extends into the piston head and the valve head (900) fits snuggle in the seats in the piston head valve seat (901).

The intake valve head (900) is pushed open by a valve rod (902*a*) one end of which is in attached to a stem (902) of the given valve (900) and the other end of which impinges upon a control peg (902*b*) that prevents the valve rod (902*a*) from traveling with the piston rod (911) for its full stroke. When the piston (950) and piston rod (911) begin their power stroke, the valve rod (902*a*) travels with them, pushed along by the valve stem (902), the inertia of the valve rod (902*a*) being overcome by the valve spring (903).

Before the piston rod (911) completes its power stroke, valve rod (902*a*) comes in contact with a control peg (902*b*). This control peg stops further travel of the valve rod (902*a*). Although the valve rod stops moving, the piston rod (911) continues traveling to the bottom of its power stroke, sliding past the now motionless valve rod (902*a*). As a result, one end of the now motionless valve rod pushes against the valve stem (902), compressing the valve spring (903) and forcing the valve head (900) open. Air or air/fuel mixture rushes through the opened valve, transiting through air or air/fuel ports (906) in the piston. Shortly thereafter, the piston rod (912) "bottoms out" finishing its power stroke, and reverses direction to start its compression stroke.

As the piston rod (911) begins its compression stroke, its motion slides the valve rod (902*a*) away from the control peg (902*b*) and allows the valve spring (903) to once again force the valve head (900) closed. As the piston (950) continues in its compression stroke, pressure above it in the combustion chamber furthers serves to keep the valve head (900) firmly seated and closed. The piston stroke continues through compression, combustion and exhaust and the cycle repeats.

Lubrication for each piston is accomplished through the dynamic pressure lubrication oil system previously described, with oil distribution accomplished via a piston oil supply port (907) and a piston oil return port (908). (Details of the lubrication system are not illustrated in order to preserve simplicity, but are essentially identical to the dynamic pressure system previously described.)

This mode provides increased control over the combustion process in that it allows independent control of the cylinder head exhaust valve and off the air or air/fuel intake valve. This control translates into cleaner, more efficient combustion and increased adaptability to a wide range of fuels. Although this mode offers significant performance benefits, it is also more complex to manufacture and maintain than the first and second preferred modes.

FIG. 10 provides increased detail as to how the various parts of the "pop-top" piston relate and function. In this drawing the valve rod (902*a*), co-axial to the piston rod (911), is pressing against valve stem (902), compressing the valve spring (903) via the valve spring collar (903*a*) and forcing the valve head (900) open. The valve stem is held in place by a valve guide (904). The piston is lubricated by oil emitting from the piston oil supply port (1006).

The piston is centered in its cylinder by the oil hoarding rings (1008) that also keep the lubrication oil from escaping above or below the piston. When the valve head (900) opens, air or fuel/ail mixture rushes up from the base of the piston (1010) through the air or air/fuel valve ports (905) past the valve seat (901) and out through the piston head (1009).

FIG. 11 displays the "pop-top" piston system viewing the opposite side from FIG. 10 so that the piston oil return port (1107) is visible. Oil is forced through this port by static pressure of additional oil pumped to the piston. The oil enters this port and returns to the engine sump/crankcase. In this illustration, the valve head (900) is closed, showing the valve spring (903) uncompressed in its resting position.

FIG. 12 provides an end view of the piston air or air/fuel ports (905), and of the piston oil supply channels (1206) and return channels (1207), that feed oil to and from the piston oil supply ports (1006) and piston oil return ports (1007), also feeding oil in minute quantities to lubricate the valve stem in the center of the piston. The relationships of the valve seat (901), valve stem (902), and valve guide (904) and the air or air/fuel valve ports (905) to the rest of the piston are defined.

In FIG. 12*a*, viewing the center section of FIG. 12 in further detail, note that opposite the bases of the piston oil supply (1206) and piston oil return (1207) channels, and extending from the sump oil pick-up pipe (1201) and from the sump oil return outlet pipe (1202), there are valve stem pinholes (1203) leading through the valve guide (904) to the valve stem (902), centered in the piston rod (911), via which minute quantities of oil may pass in order to lubricate the valve stem (902)

FIG. 13 shows the engine configured to operate with only one cylinder and piston. Particularly singled out are the reciprocating power shaft (1301) that moves only in a linier "in and out" manner and the single, unpaired magneto pick-up (1302).

In addition to the features documented in these drawings, further benefits may be derived by incorporating different means of ignition, to include not only spark plugs, but, alternatively, glow plugs and/or explosive compression in the combustion chamber.

Additionally, alternate incorporation of various drive trains, substituting, for example, a rack and pinion, ratchet drive, or unidirectional or segmented gear arrangement in place of the crank plate system here described, may render the system lighter and more compact and may allow greater flexibility in choice of fuels by providing for a greater range of piston dwell times then in rotary transmission systems, thus promoting more complete and efficient fuel combustion. The engine may also significantly benefit from addition of an oil cooler and from a turbo-charger, super-charger, intake air compressor, fan, or blower. While the invention has been described in connection a preferred embodiments, it is not intended to limit the scope of the invention to the particular forms set forth, but on the contrary, it is intended to cover such alternatives, modifications, and equivalents as may be included within the spirit and scope of the invention as defined by the appended claims.

What is claimed is:

1. An internal combustion engine machine incorporating significant improvements in power, efficiency and emissions control comprising:

(a) one or more cylinders, each comprising at least one head, combustion chamber, base, compression chamber and sidewall;

(b) one or more means of igniting fuel in the cylinder(s);

(c) one or more sources of intake air;

(d) at least one means of storing and/or cooling lubricating oil between cycles of circulation;

(e) a drive train;

(f) at least one means of encasing, protecting, cooling and lubricating the drive train;

(g) at least one means of segregating the oil in the sump and/or crankcase from the air or air/fuel mixture in the cylinder, whether within or apart from the combustion chamber;

(h) at least one means of dispersing oil on the cylinder walls and of then gathering excess for return to the oil sump;

(i) at least one means of transmitting energy to and from the pistons;

(j) at least one means of guiding each piston rod such that it moves in a linear manner, always along substantially the same line;

(k) at least one means of drawing air or air/fuel mixture into the engine machine, propelling it into the cylinder combustion chamber, compressing it for ignition and propelling its expulsion after ignition;

(l) at least one means of admitting air and fuel, or air/fuel mixture into each cylinder apart from the combustion chamber;

(m) at least one means of efficiently expelling exhaust gases resulting from combustion of the air fuel mixture after energy has been extracted;

(n) at least one means of transmitting energy from the piston rod to the drive train;

(o) at least one means of cooling the engine; and (p) at least one means of transporting dispersing gathering and returning lubricating/cooling oil while keeping it segregated from combustion air and fuel;

(q) wherein the means of efficiently expelling exhaust gases upon completion of combustion and energy extraction comprises a cylinder head exhaust valve, allowing exhaust to exit through the head of the cylinder.

2. An internal combustion engine machine incorporating significant improvements in power, efficiency and emissions control comprising:

(a) one or more cylinders, each comprising a head, a combustion chamber, a base, a compression chamber and a sidewall;

(b) one or more means of igniting fuel in the cylinder(s);

(c) one or more sources of intake air;

(d) at least one means of storing and/or cooling lubricating oil between cycles of circulation;

(e) a drive train;

(f) at least one means of encasing, protecting, cooling and lubricating the drive train;

(g) at least one means of segregating the oil in the sump and/or crankcase from the air or air/fuel mixture in the cylinder, whether within or apart from the combustion chamber;

(h) at least one means of dispersing oil on the cylinder walls and of then gathering excess for return to the oil sump;

(i) at least one means of transmitting energy to and from the pistons;

(j) at least one means of guiding each piston rod such that it moves in a linear manner, always along substantially the same line;

(k) at least one means of drawing air or air/fuel mixture into the engine machine, propelling it into the cylinder combustion chamber, compressing it for ignition and propelling its expulsion after ignition;

(l) at least one means of admitting air and fuel, or air/fuel mixture into each cylinder apart from the combustion chamber;

(m) at least one means of efficiently expelling exhaust gases resulting from combustion of the air fuel mixture after energy has been extracted;

(n) at least one means of transmitting energy from the piston rod to the drive train;

(o) at least one means of cooling the engine;

(p) at least one means of transporting, dispersing, gathering, and returning lubricating/cooling oil while keeping it segregated from combustion air and fuel; and (q) at least one means of collecting, storing, and transferring inertial energy from one drive stroke to another, comprising at least one inertial mass or flywheel.

3. An internal combustion engine machine incorporating significant improvements in power, efficiency and emissions control comprising:

(a) one or more cylinders, each comprising at least one head, combustion chamber, base, compression chamber and sidewall;

(b) one or more means of igniting fuel in the cylinder(s);

(c) one or more sources of intake air;

(d) at least one means of transporting dispersing gathering and returning lubricating and, or, or, cooling oil;

(e) at least one means of storing and/or cooling lubricating oil between cycles of circulation;

(f) at least one means of dispersing lubricating oil on the cylinder walls and of then gathering excess for return to an oil sump;

(g) at least one means of segregating lubricating oil from the combustion air or air/fuel mixture, and combustion products at substantially all points in the engine;

(h) at least one drive train;

(i) at least one means of, protecting, cooling and, or, or, lubricating the drive train;

(j) at least one means of transmitting energy to and from the pistons;

(k) at least one means of guiding each piston rod such that it moves in a linear manner, always along substantially the same line;

(l) at least one means of drawing air or air/fuel mixture into the engine machine, of propelling it into the cylinder combustion chamber, of compressing it for ignition, and of propelling its expulsion after ignition;

(m) at least one means of admitting air, fuel, or an air/fuel mixture into each cylinder; apart from the combustion chamber;

(n) at least one means of expelling exhaust gases resulting from combustion of the air fuel mixture after energy has been extracted;

(o) at least one means of transmitting energy from the piston rod to the drive train;

(p) at least one means of cooling the engine; and (q) at least one means of expelling exhaust gases upon completion of combustion and energy extraction comprising at least one cylinder head exhaust valve, allowing exhaust to exit through the head of the cylinder.

4. An internal combustion engine machine as in claim 1 comprising at least one plurality of cylinders in one or more banks of two opposing cylinders each.

5. An internal combustion engine machine as in claim 1 wherein the means of transmitting energy to and from the each piston comprises;

(a) at least one piston-rod with a piston attached at one end;

(b) each piston rod passing through the base of its cylinder, carrying the force of its associated piston power stroke to the drive train;

(c) the piston rod linked to the drive shaft by at least one push rod in the crankcase/oil sump, propelling at least one transmission mechanism, comprising at least one crank-plate, or other rotary, or linier device powering at least one drive shaft.

6. An internal combustions engine machine as in claim 1 wherein the means of cooling the engine comprises exhaust gas expansion, cooling fins and at least one volume of oil circulated through the cylinders and pooled in the sump, the sump acting as at least one heat sink for oil circulating from the cylinders.

7. An internal combustion engine machine as in claim 1 wherein the means of transmitting energy from the piston rod to the drive train comprises at least one rotary device, linked to the piston rod by at least one push rod.

8. An internal combustion engine machine in claim 1 in which the means of transmitting energy from the piston rod to the drive train comprises at least one rack and pinion transmission system, segmented gear drive, or ratchet device.

9. An internal combustion engine machine as in claim 1 wherein the means of admitting the fuel component of the air/fuel mixture into each cylinder comprises at least one fuel injector for each cylinder.

10. An internal combustion engine machine as in claim 1 wherein the means of admitting air or air/fuel mixture into each cylinder obtained by intake ports in the sidewall of each cylinder.

11. An internal combustion engine machine as in claim 1 wherein the means of efficiently expelling exhaust gases upon completion of combustion and energy extraction comprises at least one cylinder head exhaust valve, allowing exhaust to exit through the head of the cylinder.

12. An internal combustion engine machine as in claim 1 wherein a means of drawing air or air/fuel mixture into the system, propelling it into the cylinder combustion chamber, compressing it for ignition and expelling it after ignition comprises at least one multi-function piston, that:

(a) on upstroke, draws air from an intake source and into an intake/compression chamber beneath the piston, at the same time, compressing an air/fuel mixture in the cylinder combustion chamber above the piston, and then, (b) on down stroke, following combustion of the air/fuel mixture, compresses and propels scavenge air out of the intake/compression chamber below the piston, and into the cylinder combustion chamber above the piston, then, (c) on the following up-stroke, expels the scavenge air and remaining exhaust from the combustion chamber, at the same time drawing combustion air or a combustion air/fuel mixture into an intake/compression chamber below the piston, then, (d) on the following down stroke; compresses and propels the combustion air or air/fuel mixture, out of the intake/compression chamber below the piston, and into the cylinder combustion chamber above the piston, for combustion, completing a cycle.

13. An internal combustion engine machine as in claim 1 wherein a means of drawing air or air/fuel mixture into the system, propelling it into the cylinder combustion chamber, compressing it for ignition and expelling it after ignition comprises a two stroke process wherein at least one multi-function piston:

(a) on a single up stroke, draws combustion air or air/fuel mixture from the intake source and into an intake/ compression chamber beneath the piston, and compresses the air or air/fuel mixture in the combustion chamber, then, (b) upon combustion, on a single down stroke, propels combustion air or air fuel mixture out of the compression chamber into a cylinder combustion chamber above the piston, at the same time expelling the exhaust from the combustion chamber and completing the combustion/exhaust cycle.

14. An internal combustion engine machine as in claim 1 wherein the means of guiding each piston rod such that it moves in a linear manner, always along substantially the same line, comprises at least one compression wall and at least one piston rod compression seal, the compression seal serving as a piston rod guide to hold each piston in correct position within its cylinder.

15. An internal combustion engine machine as in claim 1 wherein there is provided for each cylinder, at least one multi-function piston performing in four strokes, intake, compression, combustion, exhaust and power functions plus lubrication, these comprising, to:

(a) draw in new combustion air or air/fuel mixture into an intake/compression chamber, separate from the cylinder combustion chamber, (b) compress and propel the new air or air/fuel mixture from the intake/compression chamber, into the cylinder combustion chamber, (c) compress the air/fuel mixture in the cylinder combustion chamber, (d) draw in scavenge air into an intake/compression chamber, separate from the cylinder combustion chamber, (e) receive the force of combustion for transmission to the piston rod, (f) compress and propel the scavenge air from the intake/compression chamber, into the cylinder combustion chamber, (g) compress and propel the scavenge air and combustion by-products from the cylinder combustion chamber as exhaust, and (h) receive, disperse and recoup lubricating oil for return to the oil sump/cooler.

16. An internal combustion engine machine as in claim 1 wherein there is provided for each cylinder, at least one multi-function piston performing, in two strokes, intake, compression, combustion, exhaust and power functions plus lubrication, these comprising, to:

(a) in a single upstroke, draw new combustion air or air/fuel mixture into an intake/compression chamber, separate from a cylinder combustion chamber, and in the same action, compress an air/fuel mixture in the cylinder combustion chamber, (b) receive the force of combustion for transmission to the piston rod, (c) in a single down-stroke, upon combustion in the cylinder combustion chamber, compress and propel the new air or air/fuel mixture from the intake/compression chamber, into the cylinder combustion chamber, and in the same action, scavenge and exhaust combustion by-products from the cylinder combustion chamber, and, (d) receive, disperse and recoup lubricating oil for return to the oil sump/cooler.

17. An internal combustion engine machine as in claim 1 wherein the means of dispersing oil on the cylinder walls and of then gathering excess for return to the oil sump comprises oil hoarding rings, at least one ring located near the head and base of at least one piston, such that the rings contain any oil dispersed between them, and when in motion, push said oil before them, substantially wiping it off the cylinder walls as they move.

18. An internal combustion engine machine as in claim 1 wherein a means of segregating the oil in the sump and/or crank case from the air or air/fuel mixture in the cylinder comprises at least one compression wall and piston rod pressure seal at the base of at least one cylinder;

(a) the compression wall segregating the fuel, air, or combustion by-products in at least one cylinder from the lubricating, and, or, or, oil in the oil sump/crankcase, thus creating at least one segregated and sealed intake chamber into which the air or fuel/air mixture is first received from the carburetor, breather, or other combustion air source, and from which it is discharged into the cylinder combustion chamber; and (b) a piston rod passing through the compression wall at the base of each corresponding cylinder and into the sump/crankcase by way of the compression wall and pressure seal.

19. An internal combustion engine machine as in claim 1 wherein a means of encasing, protecting, and lubricating the drive train comprises at least one combination crankcase, and, or, or, oil sump.

20. An internal combustion engine machine as in claim 1 wherein a means of storing and/or cooling the oil between cycles of circulation comprises at least one combination crankcase/oil sump.

21. An internal combustion engine machine as in claim 1 wherein a source of intake air comprises at least one carburetor.

22. An internal combustion engine machine as in claim 1 wherein a means of igniting the fuel comprises an electrical spark.

23. An internal combustion engine machine as in claim 1, wherein a means of transporting, dispersing, gathering and returning lubricating, and, or, or, cooling oil while keeping it segregated from combustion air and fuel comprises;

(a) at least one dynamic force lubricating oil pump comprising at least one piston rod/lubrication assembly that serves as both at least one means of transmitting force to and from the piston and as at least one means to transmit lubricating/cooling oil to as associated cylinder via at least one multi-function piston assembly;

(b) at least one multi-function-piston assembly comprising at least one piston rod with at least one multi-function piston attached to either or each end, and having one or more oil pick-up and exhaust ports in its mid section, and one or more oil transport passages in the piston rod from the oil pick-up nozzles to the multi-function-piston and back to the oil exhaust ports;

(c) each multi-function-piston comprising one or more radially situated oil inlet and outlet ports that distribute lubricating oil to the associated cylinder and recover the oil for return to the sump/crankcase, and each multi-function piston also comprising;

(d) at least one oil hoarding ring near each piston head and base to assist in dispersing and then re-gathering the oil for return to a sump such that oil flows through the piston rod and piston, and around the piston, lubricating and cooling piston walls, piston rings and cylinder walls, and returns through the piston and piston rod to the oil sump.

24. An internal combustion engine machine as in claim 1 wherein at least one wrist pin links each piston to its piston rod.

25. An internal combustion engine machine as in claim 1 wherein a means of igniting fuel in the cylinders comprises explosive compression in the cylinder head.

26. An internal combustion engine machine as in claim 1 wherein a means of igniting fuel in the cylinders comprises at least one glow plug.

27. An internal combustion engine machine as in claim 1 wherein a means of igniting fuel in the cylinders comprises at least one electrical spark.

28. An internal combustion engine machine as in claim 2 wherein a means of transmitting energy to and from the pistons comprises at least one piston-rod between and joining each pair of pistons in each cylinder bank such that each piston rod has a piston at each end, (a) each piston rod passing through the base of its associated cylinder, each piston rod carrying the force of its associated piston power stroke to the drive train, and across to the opposite associated piston, thereby, powering that piston's compression stroke, and (b) at least one piston rod linked, directly or indirectly, to a drive shaft, via at least one rotary or linier energy transmission device.

29. An internal combustion engine machine as in claim 2 comprising at least one plurality of banks of cylinders, each bank comprised of two or more cylinders and the drive train of each bank joined to the drive train of its neighboring bank(s) in such a way that each bank may be independently disconnected from its neighbor(s) and shut down automatically or at the discretion of the operator, the manner of joining the bank drive trains being, in example, manual clutch(es), centrifugal clutch(es), or ratchet devices.

30. An internal combustion engine machine incorporating significant improvements in power, efficiency and emissions control comprising;

(a) one or more cylinders, each comprising at least one head, combustion chamber, base, compression chamber and sidewall;

(b) one or more means of igniting fuel in the cylinder(s);

(c) one or more sources of intake air;

(d) at least one means of storing and/or cooling lubricating oil between cycles of circulation;

(e) a drive train;

(f) at least one means of encasing, protecting, cooling and lubricating the drive train;

(g) at least one means of segregating the oil in the sump and/or crankcase from the air or air/fuel mixture in the cylinder;

(h) at least one means of dispersing oil on the cylinder walls and of then gathering excess for return to the oil sump;

(i) at least one means of transmitting energy to and from the pistons;

(j) at least one means of guiding each piston rod such that it moves in a linear manner, always along substantially the same line;

(k) at least one means of drawing air or air/fuel mixture into the engine machine, propelling it into the cylinder combustion chamber, compressing it for ignition and propelling its expulsion after ignition;

(l) at least one means of admitting air and fuel, or air/fuel mixture into each cylinder;

(m) at least one means of efficiently expelling exhaust gases resulting from combustion of the air fuel mixture after energy has been extracted;

(n) at least one means of transmitting energy from the piston rod to the drive train;

(o) at least one means of cooling the engine; and (p) at least one means of transporting, dispersing, gathering, and returning lubricating/cooling oil while keeping it segregated from combustion air and fuel;

(q) wherein, the means of transporting, dispersing, gathering and returning lubricating/cooling oil while keeping it segregated from combustion air and fuel comprises at least one dynamic force lubricating oil pump comprising;

(r) at least one piston rod/lubrication assembly that serves both as at least one means of transmitting force to and from the piston and as at least one means to transmit lubricating/cooling oil to and from its cylinder in concert with at least one multi-function piston;

(s) the piston rod/lubrication assembly comprising at least one piston rod with a multi-function piston attached to each end, oil pick-up nozzles and exhaust ports in its mid section, and oil transport passages in the piston rod from the oil pick-up nozzles to the multi-function piston and back to the oil exhaust ports;

(t) the multi-function piston comprising at least one piston configured with one or more radially situated oil inlet and outlet ports that distribute lubricating oil received from the piston rod/lubrication assembly, to the associated cylinder, and that recover the oil for return to the sump/crankcase via the piston rod/lubrication assembly; and (u) the multi-function-piston assembly also comprising oil hoarding rings near each piston head and base to assist in dispersing and then re-gathering the oil for return to the cooling, sump such that oil flows through the piston rod and piston, and around the piston, and returns through the piston and piston rod to the oil sump/crank case.

* * * * *